United States Patent [19]

Donnally et al.

[11] 4,339,225

[45] Jul. 13, 1982

[54] POWER SHOVEL CROWD DRIVE ASSEMBLY

[75] Inventors: Robert B. Donnally; Mark W. Trevithick, both of Marion, Ohio

[73] Assignee: Dresser Industries, Inc., Dallas, Tex.

[21] Appl. No.: 165,925

[22] Filed: Jul. 27, 1980

Related U.S. Application Data

[63] Continuation of Ser. No. 894,610, Apr. 7, 1978, abandoned.

[51] Int. Cl.[3] ..... E02F 3/75

[52] U.S. Cl. ..... 414/690; 414/727

[58] Field of Search ..... 414/718, 694, 695, 690, 414/693, 722, 727; 52/118, 121

[56] References Cited

U.S. PATENT DOCUMENTS

| | | | |
|---|---|---|---|
| 1,254,295 | 1/1918 | Weston | 414/690 |
| 2,315,781 | 4/1943 | Gerow | 414/690 |
| 3,004,674 | 10/1961 | Griffith | 414/690 X |
| 3,045,844 | 7/1962 | Learmont et al. | 414/690 |
| 3,782,790 | 1/1974 | Benkowski | 308/3 R |

*Primary Examiner*—Leslie J. Paperner

[57] ABSTRACT

A crowd drive assembly for a power shovel is described. The power shovel includes a main frame, a boom connected at the lower end thereof to the main frame, a dipper handle pivotally connected to the boom and a dipper connected to the dipper handle. A rack and pinion crowd drive arrangement is provided wherein a yoke is mounted within an opening in the boom for receiving and guiding the dipper handle as it is extended and retracted by the crowd drive. A shipper shaft is journaled in the boom and extends through trunnions therein. The yoke is pivotally mounted, coaxially with the shipper shaft directly on the trunnions which are an integral part of the boom so that loads experienced by the yoke are transmitted directly to the boom and not to the shipper shaft. A removable bearing housing arrangement supports the yoke on the trunnions.

8 Claims, 6 Drawing Figures

POWER SHOVEL CROWD DRIVE ASSEMBLY

This is a continuation of application Ser. No. 894,610, filed Apr. 7, 1978, now abandoned.

BACKGROUND OF THE INVENTION

This invention relates to power shovels and more particularly to a crowd drive assembly for a power shovel having a main frame, a boom connected at a lower end thereof to the main frame, a dipper handle connected to the boom and a dipper pivotally connected to the dipper handle, as well as the crowd drive assembly which operates to extend and retract the dipper handle relative to the boom during the shovel's cycles of operation and the structure for guiding and supporting the dipper handle.

Conventional types of power shovels generally utilize a crawler assembly, a main frame rotatably mounted on the crawler assembly, a boom connected at its lower end to the main frame, a gantry mounted on the main frame, and pendants interconnecting the boom with the gantry for maintaining the boom at a predetermined angle. A dipper handle is mounted on the boom for longitudinally reciprocal and pivotal movement, a dipper is connected to the end of the dipper handle, a hoist line is connected to the dipper and passes around a sheave mounted at the point of the boom and which is operatively connected to a hoist mechanism mounted on the main frame. A crowd drive mechanism is provided whereby the dipper handle is extended or "crowded" for digging and retracted.

Earlier forms of power shovels utilized a dipper handle which was a single member, and the dipper handle was driven for crowding by a rack and pinion arrangement, e.g., a rack mounted on the dipper handle and a pinion driven on a shipper shaft journaled through the boom. Customarily, the single member dipper handle was supported and guided by a yoke member which received the dipper handle and which has pivotally mounted directly on the shipper shaft.

As machines grew larger, the increased loads being experienced by the dipper handle, yoke block and boom and the mechanisms by which these could be handled caused a change in the design of the dipper handle. These loads were especially troublesome when the corners of the dipper receive the principal loading, as in corner digging, and when a side loading of the dipper occurs, as when the dipper is being used to load a truck. These forces essentially create motions of the dipper handle about two axes in the vertical plane of the dipper handle. Firstly, there is a torsional motion of the dipper handle about its axis or in substantially a horizontal axis in the aforementioned vertical plane and secondly a side-to-side motion of the dipper handle which can be considered as essentially occurring in a vertical axis in the vertical plane of the dipper handle. The single member dipper handle was generally replaced in most larger machines by a bifurcated dipper handle with the ends of the handle extending around the outside of the boom. A saddle block or yoke member carries the bifurcated dipper handle, and this form of yoke member is, as well, mounted directly on the shipper shaft. Thus, in both forms of machines as now conventionally built, the loads received by the yoke member from the dipper handle are transferred to the shipper shaft prior to being transmitted to any other part of the structure. This can result in bending or otherwise distorting the shipper shaft requiring replacement, or in the alternative, the manufacture of an unusually sturdy, and therefore undesirably heavy, shipper shaft.

Accordingly, it is an object of this invention to provide an improved crowd drive assembly for a power shovel of the type described hereinabove.

Another object of this invention is to provide an improved structural arrangement for a crowd drive mechanism in a power shovel of the foregoing type wherein loads experienced by the dipper handle are transferred directly to the boom.

A further object of this invention is to provide an improved crowd drive assembly and dipper handle supporting structure wherein a single member dipper handle can be used.

An additional object of this invention is to provide an improved crowd drive assembly for a power shovel of the foregoing type wherein the structural member carrying the dipper handle in the boom without intervention of other structural members such as a shaft is mounted directly on the boom whereby loads experienced by the dipper handle are transferred directly thereto.

Still another object of this invention is to provide an improved dipper handle supporting structure in a crowd drive assembly in a power shovel of the type described hereinabove wherein either the yoke member or the shipper shaft and parts mounted thereon can be readily removed for servicing without requiring that the entire structure be disassembled.

SUMMARY OF THE INVENTION

The foregoing and other objects are obtained in a power shovel construction of the type described hereinabove wherein a single member dipper handle is carried on the boom by a yoke member mounted directly on the boom in such a way that loads received by the dipper handle creating motions, such as the torsional and side-to-side motions in prior art structures, are restrained. More particularly, the yoke member is pivotally carried by bosses or trunnions which are an integral part of the boom structure. Thus, loads imposed on the yoke by the dipper handle are transferred directly to the boom structure.

In a specific embodiment a shipper shaft is journaled through the boom and extends through the afore-mentioned trunnions. The shipper shaft carries pinions for driving a rack mounted for engagement with the pinions on the dipper handle. The shipper shaft is driven by appropriately mounted and geared drive motors in the usual fashion. The yoke block for receiving and guiding the dipper handle is itself mounted on a bearing housing which is in turn pivotally mounted on the afore-mentioned trunnion. The yoke block is pivotally mounted on the boom structure by a bearing housing from which it is immediately removable by means of removable pins connecting it to the bearing housing. This permits ready removal of the yoke member and will also permit direct servicing of the shipper shaft and components mounted thereon.

BRIEF DESCRIPTION OF THE DRAWINGS

The principles of the invention will be more readily understood by reference to the description of a preferred embodiment given hereinbelow in conjunction with the drawings which are briefly described as follows.

DETAILED DESCRIPTION OF THE PREFERRED EMBODIMENT

Figure 1:
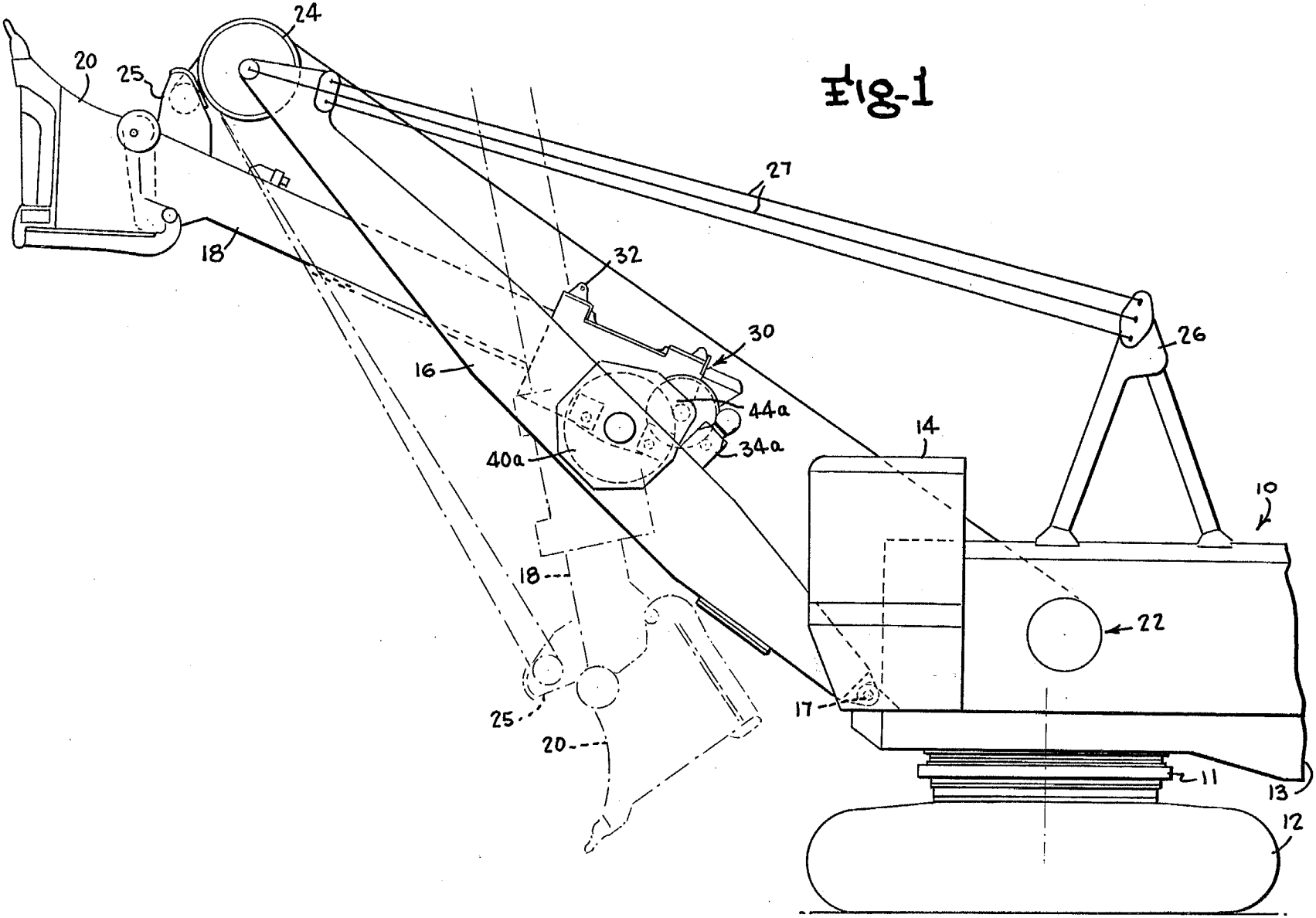
FIG. 1 is a side elevational view of a preferred embodiment of the improved power shovel constructed according to the principles of the invention.

Referring to FIG. 1 of the drawings, there is shown an improved power shovel having a preferred embodiment of the crowd drive assembly according to the invention, which facilitates the use of a single member dipper handle for reasons which will become clear from the description hereinbelow.

Power shovel 10 includes a crawler unit 12 provided with a roller circle 11 for rotatably supporting main frame 13 including operation cab 14. The shovel is provided with a boom 16 connected at its lower end to the front end of main frame 13 by means of footpins 17. The boom is maintained at a fixed angle by means of pendants 27 interconnecting the upper end or point of the boom and the upper end of a gantry 26. The point of the boom is provided with sheave 24 around which passes hoist line 32 which is driven by hoist mechanism 22 mounted on main frame 13. At its other end, the hoist line 32 is connected to a linkage 25 by which the hoist line, driven by hoist mechanism 22 pivots dipper handle 18 in an arc about an axis defined by shipper shaft 36.

Dipper handle 18 extends through an opening 15 (see FIG. 2) in the interior of boom 16 and is guided and supported therein and driven for extension and retraction by crowd drive assembly 30. The dipper handle is mounted for reciprocable motion through a yoke member 30, and this motion is effected by operation of a rack and pinion arrangement wherein the rack 38 is mounted on dipper handle 18, while pinions 56 are mounted for rotation with a shipper shaft 36. The drive source for operation of the shipper shaft pinions is a pair of motors 34*a* and 34*b* which, respectively, drive shipper shaft gears 44*a* and 44*b* on each side of the shipper shaft 36; these gears are to be found within shipper shaft gear housings 40*a* and 40*b*.

FIG. 1 is a range drawing which illustrates the various portions of the operating cycle of power shovel 10. Initially, the dipper handle is fully retracted, and the hoist line is paid out to position the dipper at the illustrated position adjacent the main frame of the machine. The dipper handle is then extended by the crowd mechanism to crowd the dipper into the material being excavated, and the hoist line is taken in either simultaneously or sequentially with the extension of the dipper handle to fill the dipper and hoist it to a dump position. In this manner, the dipper moves in a generally arcuate line of travel by judicious operation of the hoist mechanism and the crowd mechanism.

Figure 2:
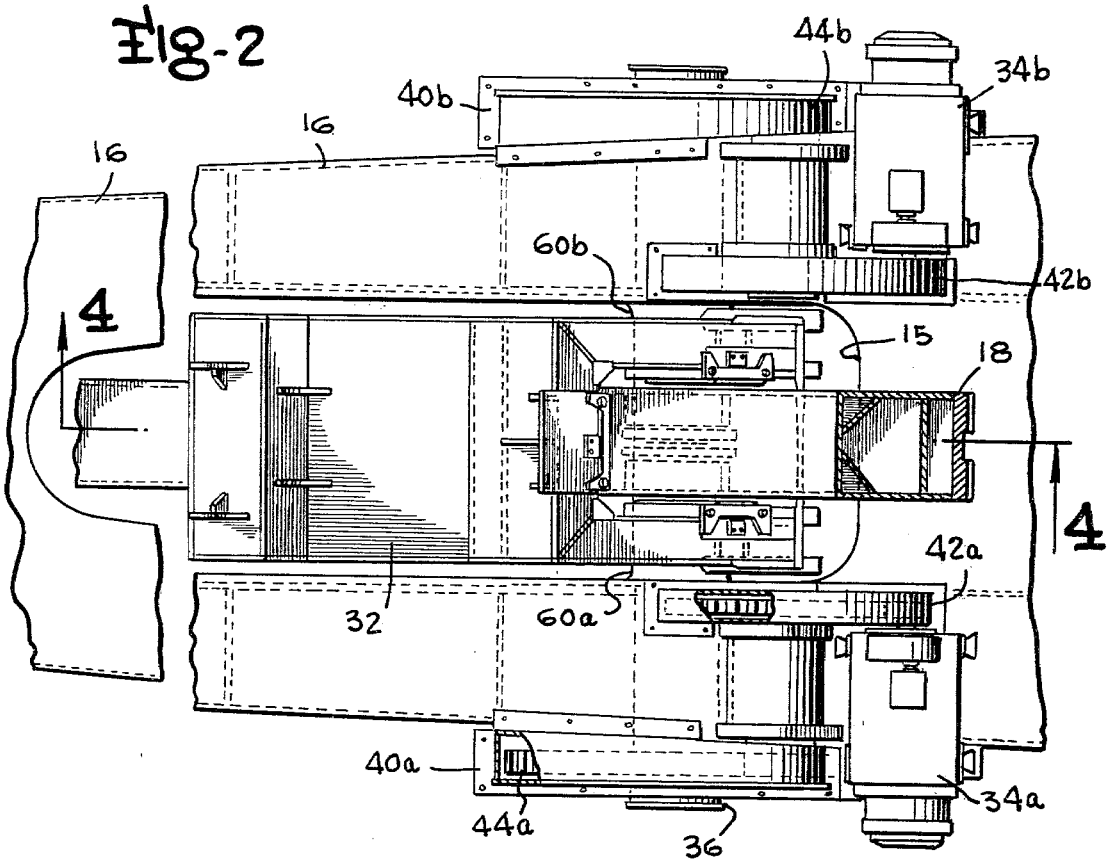
FIG. 2 is a broken top elevational view of that portion of the boom structure on the FIG. 1 power shovel where the crowd assembly according to the invention is arranged.
Figure 3:
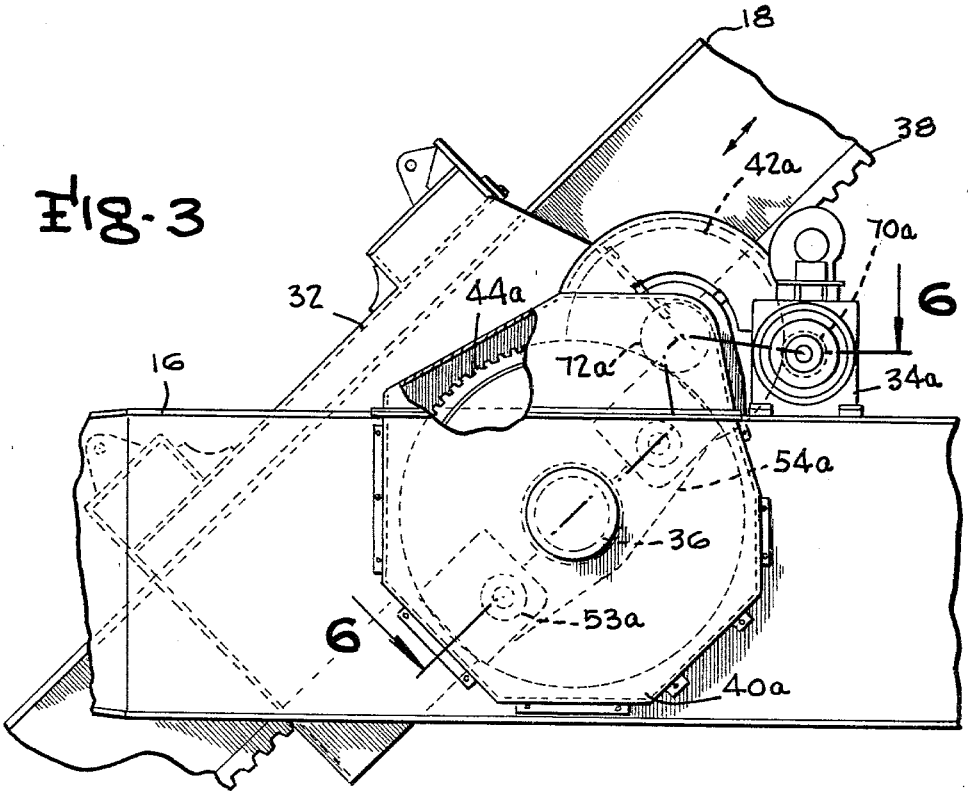
FIG. 3 is a side elevational view of that portion of the boom structure and crowd drive assembly shown in FIG. 1.

FIGS. 2 and 3 are, respectively, broken top and side elevation views of that portion of the boom structure where the crowd drive assembly according to the invention is arranged. As illustrated, dipper handle 18 extends through an opening 15 in the interior of this portion of boom 16 and is supported therein by yoke 30. The yoke is pivotally mounted in a manner to be described in detail below on trunnions or bosses 60*a* and 60*b* which also are described further hereinbelow. Yoke 30 receives and holds the dipper handle so that loads being tranmitted through the dipper handle are directed through the yoke and directly to the boom. As is clear from the drawings, the construction of the specifically disclosed yoke 30 permits it to restrain its motion about the two axes in the dipper handle's vertical plane discussed hereinabove.

Drive motors 34*a* and 34*b* by means of, respectively, intermediate gears 42*a*, 42*b* and shipper shaft gears 44*a* and 44*b*, which are housed in gear housings 40*a* and 40*b*, and appropriate drive shafts and pinions rotatably drive shipper shaft 36. Pinions (see FIG. 6) engage with rack 38 on dipper handle 18 for extending and retracting the dipper. The structures and drive trains illustrated in these Figures are described in greater detail below.

Figure 4:
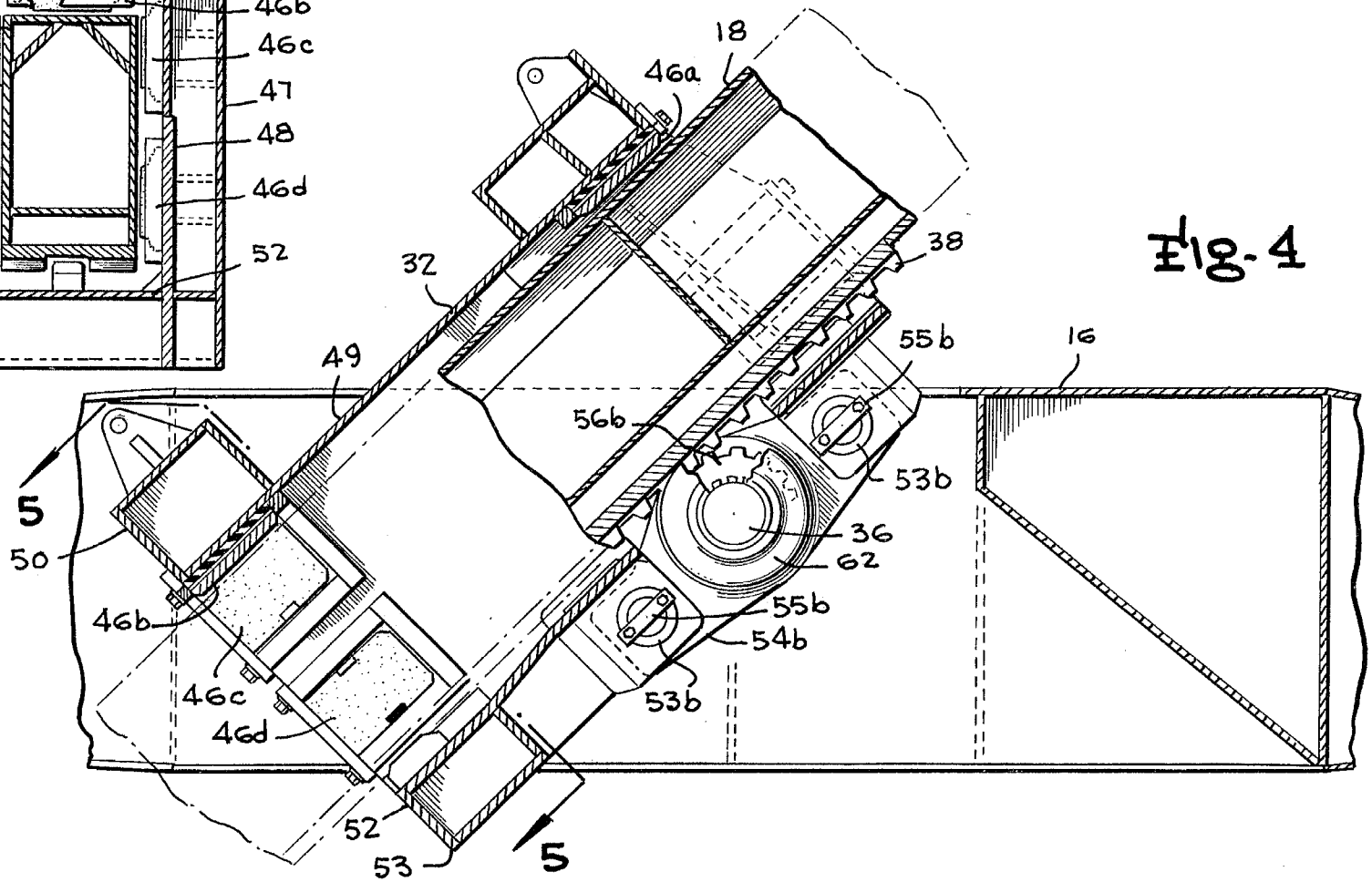
FIG. 4 is a side cross section taken along the line 4—4 in FIG. 2.
Figure 5:
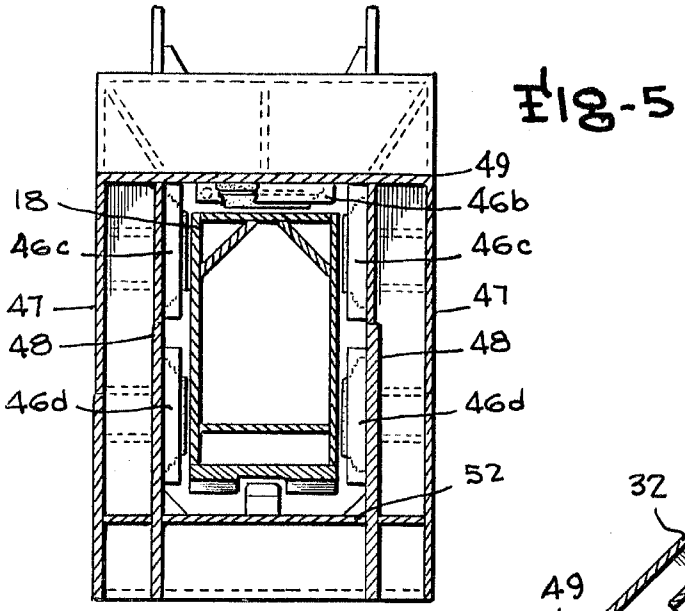
FIG. 5 is a cross sectional view taken along the line 5—5 in FIG. 4.

FIGS. 4 and 5 illustrate in greater detail the construction of yoke 30 and the means by which it is mounted on the boom about trunnions 60*a* and 60*b*. As is more apparent from FIG. 5, walls 47 and 48 extend the length of both sides of yoke 32 and form a double side wall structure. The top and bottom walls are formed, respectively, by wall members 49 and 52. At the forward portion of yoke 30, i.e., that portion illustrated in FIG. 5, the top and bottom walls are further strengthened by the presence of channel shaped members 50 and 53, which extend the width of the yoke. The dipper handle 18 is guided in yoke 30 with pairs of upper and lower side wear pads 46*c* and 46*d*; an upper wear pad 46*b* is provided in this portion of the yoke to prevent metallic contact with the upper surface of the boom. In addition, a similar wear pad 46*a* is provided at the upper rear portion of the interior of yoke 30. The wear pads may be formed from any material which will facilitate the substantially friction-free movement of the dipper handle through yoke 30 while resisting wear; as is well known, a wide variety of such materials are readily available.

As mentioned hereinabove, especially with single member dipper handle power shovel structures, loads transmitted by the dipper handle to the yoke member and the shipper shaft have been a significant problem in view of the bending or distortion of these members which could readily occur. The corner loading often experienced at the dipper of such machines, when transmitted through the dipper handle, can, if of sufficient magnitude, cause bending of the yoke members in prior art devices. The yoke structure as described hereinabove and illustrated in FIGS. 4 and 5 provides a significantly strengthened yoke member capable of resisting forces transmitted by the dipper handle, and one which is very unlikely to be twisted in the manner experienced with prior art structures.

As discussed hereinabove, yoke 30 is constructed to be mounted to pivot about trunnions 60*a* and 60*b* so that loads experienced by the yoke including the aforementioned torsional and side loads, are transferred directly to those trunnions and thereby directly to the boom. This is accomplished by the structural arrangement best illustrated in FIGS. 4 and 6. A pair of bearing housings 54*a* and 54*b* are provided, and shipper shaft 36 is journaled through these bearing housings in addition to the boom. In turn, the bearing housings are removably connected to yoke member 30. Each bearing housing is provided with a pair of openings 53 which register with similar openings in the yoke member. Pairs of pins 55*a* and 55*b* extend respectively through these openings and the similar such openings in the yoke member so that the yoke is, until those pins are removed, fixedly connected to the bearing housing. The details of the particular connected arrangement of the mating portions of the yoke member and bearing housings are discussed below in connection with FIG. 6.

It is to be noted that upon removal of the four pins 55, the yoke and shipper shaft structures, including the other components mounted on the shaft, are independently and readily available for servicing without requiring one to substantially dismantle this entire portion of the power shovel structure. Removal of the pins 55 will allow the yoke member to be moved away from the bearing housings 54. If servicing of the shipper shaft or components mounted thereon is required, upon relief of the downward force of the dipper handle, the shipper shaft can be readily removed from the boom with little further effort. These possibilities for accessibility of these components were not available in prior art structures, where the yoke is mounted directly on the shipper shaft.

Figure 6:
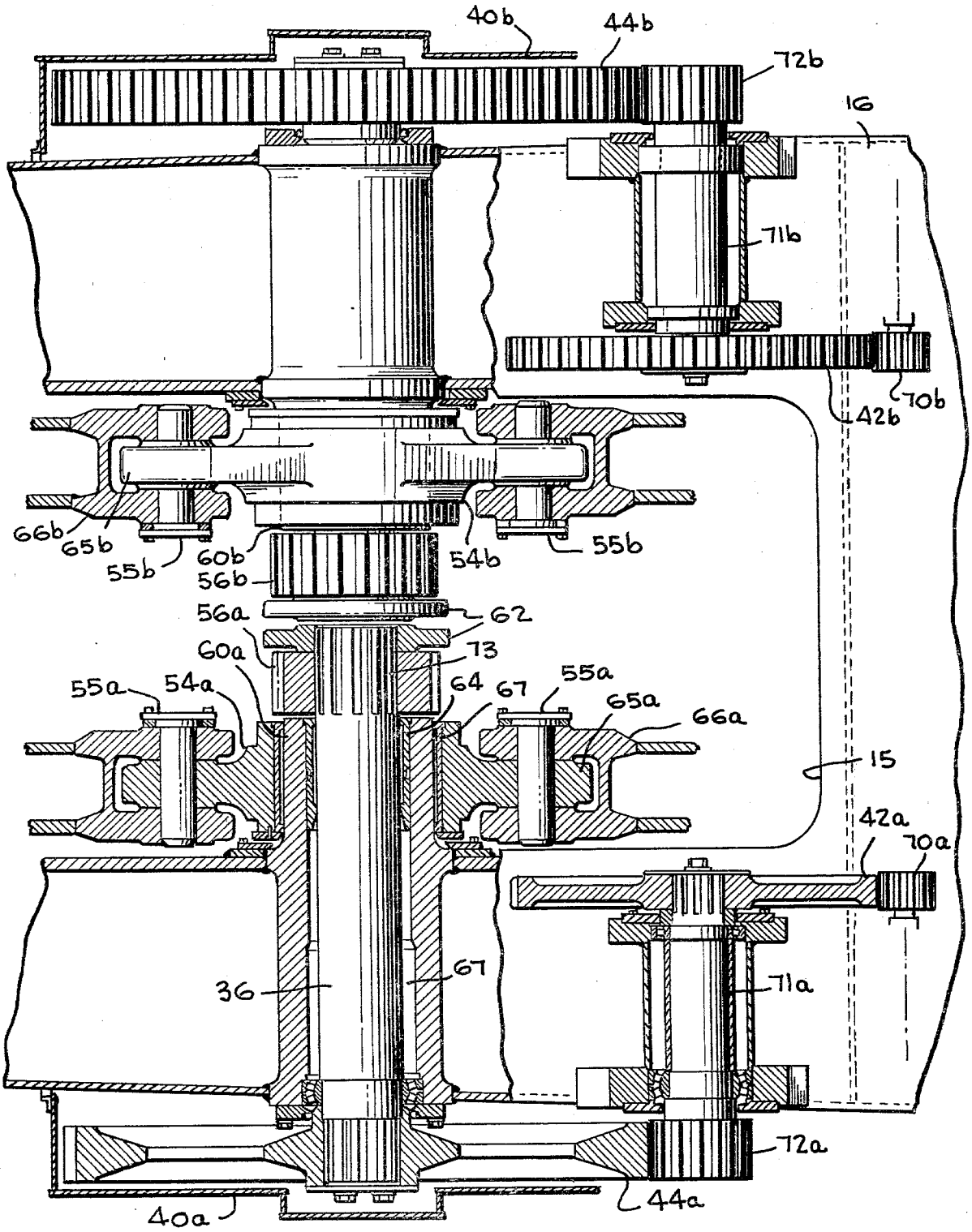
FIG. 6 is a top cross sectional view taken along the line 6—6 in FIG. 3.

FIG. 6 provides a more detailed depiction of the yoke-shipper shaft structural relationship and the means by which the shipper shaft is driven. FIG. 6 is a cross-sectional view taken through the line 6—6 in FIG. 3.

As previously indicated, the shipper shaft receives its driving energy from crowd motors 34*a* and 34*b* (FIG. 2). These motors are not shown in FIG. 6, but pinions 70*a* and 70*b* connected, respectively, to the output driveshafts of motors 34*a* and 34*b* are shown. These drive, respectively, intermediate gears 42*a* and 42*b* connected directly, respectively, to intermediate shafts 71*a* and 71*b*. The opposite ends of intermediate shafts 71*a* and 71*b* are equipped with intermediate pinions 72*a* and 72*b*. The intermediate pinions drive, respectively, the shipper shaft gears 44*a* and 44*b*. The latter gears are journaled on the opposite ends of shipper shaft 36 exteriorly of boom 16, but within gear housings 40*a* and 40*b*.

Shipper shaft 36 is journaled through the width of boom 16 including trunnions 60*a* and 60*b*. The shipper shaft has rotatably mounted thereon at splines 73 pinions 56*a* and 56*b* which engage with rack 38 (FIG. 4) for extending or retracting the dipper handle 18. The pinions 56*a* and 56*b* are separated by guide rollers 62. Bearing housings 54*a* and 54*b* are pivotally mounted on, respectively, on trunnions 60*a* and 60*b* through which shipper shaft 36 is journaled. Trunnions 60*a* and 60*b* are integral portions of the structure of boom 16. If desired, the trunnions may be separatedly formed and attached to the boom by permanent welds.

Bearing housings 54*a* and 54*b* are mounted for free pivotal movement about trunnions 60*a* and 60*b* and are separated therefrom by bushings 67. The shipper shaft 36 extends through trunnions 60*a* and 60*b*, and the surfaces of these two members are separated by shipper shaft bushings 64. Thus, although not directly mounted thereon, the bearing housings, and thereby the yoke, are pivotally mounted to the boom structure coaxial with the shipper shaft, but they are not directly connected to the shipper shaft. The bearing housings, and therefore the yoke, are directly mounted on the trunnions which are structurally integral with the boom 16. Loads such as cornering loads experienced by the dipper are transmitted through the dipper handle to the yoke, and instead of these loads being transmitted to the boom via the shipper shaft, the boom immediately receives these loads directly from the yoke in accordance with the principles of this invention.

Greater details regarding the connected arrangement between the bearing housing and the yoke are to be found in FIG. 6 as well. It will be remembered that the yoke is directly connected in a removable fashion to bearing housings 54 by means of the pairs of pins 55*a* and 55*b*. The outer ends bearing housings 54 are in the form of tongue-like projections 65. These projections are received in clevis-like portions 66*a* and 66*b* of yoke member 30. The projection portions of the bearing housings and the clevis portions of the yoke member are equipped with registrable openings through which the pins are passed. This form of attachment provides the firm engagement necessary to directly and fully transmit the loads experienced by the yoke to trunnions 60*a* and 60*b*, and thereby to the boom structure 16.

The preferred embodiment of the invention described hereinabove constitutes a power shovel structure having a crowd drive assembly which functions to transmit loads received from the dipper handle directly to the boom or directly to that portion of the shovel structure least likely to be damaged or distorted by those loads, especially when they are of unusual magnitude. As described, this is accomplished by directly, but pivotally, connecting that portion of the crowd drive structure which directly receives the dipper handle to the boom, rather than connecting it to the shipper shaft as is done in the prior art structures. In so doing, the yoke portion of the crowd drive assembly is still allowed to pivot freely with dipper handle movement about the same axis as the axis about which the shipper shaft rotates in driving the dipper handle. Accordingly, this improved load transfer characteristic is accomplished without impairing the freedom of movement of the dipper handle and without significantly increasing the structural complexity and weight of the crowd drive assembly. In addition, the particular mounting arrangement of the yoke with respect to the boom trunnions, i.e., by means of the removable bearing housing, provides for servicing of the yoke and the shipper shaft assembly independently of one another and without the extensive dismantling operations required of prior art devices.

The foregoing load transfer arrangement provides for the possibility of again constructing power shovels of the larger capacities now needed using only a single member dipper handle. Thus, it is now possible to construct such power shovels using lighter weight and less complex structures.

The details of a preferred embodiment described hereinabove are considered only as being exemplary of the principles of the invention. It is contemplated that those skilled in the art will readily be able to utilize equivalent structural components or structural arrangements while still attaining the advantages arising out of this invention, and while remaining within the spirit and scope of the invention as defined in the appended claims.

What is claimed is:

1. In a power shovel including a main frame, a boom connected at the lower end thereof to the main frame, dipper handle means reciprocably and pivotally mounted on the boom, a dipper connected to an end of said dipper handle and a hoist mechanism operatively connected to said handle via the point of said boom, an improved crowd drive assembly including drive means for extending and retracting said dipper handle means, the improvement comprising:

yoke means for guiding and supporting said dipper handle means in relation to said boom, said yoke means being pivotally mounted directly on said boom in such manner that loads exerted by said dipper handle, including loads creating a torsional motion or side-to-side motion of said dipper handle, on said yoke means are transmitted directly to said boom.

2. The improved power shovel crowd drive assembly defined in claim 1, wherein said boom includes bosses formed integrally therewith on which said yoke means is pivotally mounted.

3. The improved power shovel crowd assembly defined in claim 2, wherein a shaft for communicating drive motion to said dipper handle is journaled into said boom through the interior of said bosses so that the pivot axis of said yoke means is coaxial with the rotational axis of said shaft.

4. The improved power shovel crowd drive assembly defined in claim 3, further comprising removable mounting means for pivotally mounting said yoke means on said bosses and including removable connection means for securing said mounting means to said yoke means.

5. The improved power shovel crowd drive assembly defined in claim 4, wherein said mounting means is a bearing housing journaled on said bosses.

6. A power shovel comprising:

a boom having its lower end attached to said main frame, a single member dipper handle extending through an opening interiorly of said boom, said dipper handle being connected to said boom for pivotal and longitudinal motion, yoke means directly and pivotally connected to said boom for guiding and supporting said dipper handle and for transmitting loads from said dipper handle directly from said yoke means to said boom, a dipper mounted on an end of said dipper handle, drive means for extending and retracting said dipper handle and hoist means for raising and lowering said dipper handle.

7. The power shovel defined in claim 6, wherein said boom includes bosses formed integrally therewith, said yoke means being pivotally mounted on said bosses.

8. The power shovel defined in claim 7, wherein said drive means includes a driven shaft journaled into said boom through the interior of said bosses and engaging gear means for extending and retracting said dipper handle with rotation of said shaft, said yoke means having a pivot axis coaxial with the rotational axis of said shaft.

* * * * *

UNITED STATES PATENT AND TRADEMARK OFFICE

CERTIFICATE OF CORRECTION

PATENT NO. : 4,339,225

DATED : Jul. 13, 1982

INVENTOR(S) : Robert B. Donnally; Mark W. Trevithick

It is certified that error appears in the above-identified patent and that said Letters Patent is hereby corrected as shown below:

On the Title Page

Column 1, Item [22] should read

-- Filed: [Jul.] Jun. 27, 1980 --.

Signed and Sealed this

Fifth Day of October 1982

[SEAL]

Attest:

GERALD J. MOSSINGHOFF

Attesting Officer

Commissioner of Patents and Trademarks